US006035550A

United States Patent [19]

Okui et al.

[11] Patent Number: 6,035,550

[45] **Date of Patent: *Mar. 14, 2000**

[54] METHOD AND APPARATUS FOR TREATING BOG IN A LOW TEMPERATURE LIQUID STORAGE TANK

[75] Inventors: Toshiharu Okui, Tama; Yuriko Maeda, Tokyo; Motoichi Ikeda, Zushi, all of Japan

[73] Assignee: Tokyo Gas Co., Ltd., Tokyo, Japan

[ * ] Notice: This patent is subject to a terminal disclaimer.

[21] Appl. No.: 09/064,943

[22] Filed: Apr. 22, 1998

[30] Foreign Application Priority Data

Apr. 28, 1997 [JP] Japan ..... 9-124958

[51] Int. Cl.[7] ..... F25B 3/00

[52] U.S. Cl. ..... 34/448; 34/452; 62/46.1

[58] Field of Search ..... 62/46.1, 46.3; 34/452, 448

[56] References Cited

U.S. PATENT DOCUMENTS

| | | | |
|---|---|---|---|
| 3,967,465 | 7/1976 | Asselman et al. | 62/46.3 |
| 4,259,846 | 4/1981 | Rudolphi et al. | 62/46.3 |
| 5,544,490 | 8/1996 | Manini et al. | 62/46.1 |
| 5,787,605 | 8/1998 | Okui et al. | 62/46.1 |

FOREIGN PATENT DOCUMENTS

| | | |
|---|---|---|
| 49-104213 | 10/1974 | Japan . |
| 8-219397 | 8/1996 | Japan . |
| 9-210295 | 8/1997 | Japan . |

*Primary Examiner*—Ronald Capossela

*Attorney, Agent, or Firm*—Flynn Thiel, Boutell & Tanis, P.C.

[57] ABSTRACT

A method and apparatus of treating the BOG generated in low temperature liquid storage tanks are described, wherein the BOG is strongly adsorbed to and stored in a porous material by contacting the BOG with the porous material in the presence of a compound serving as a host.

11 Claims, 5 Drawing Sheets

METHOD AND APPARATUS FOR TREATING BOG IN A LOW TEMPERATURE LIQUID STORAGE TANK

BACKGROUND OF THE INVENTION

1. Field of the Invention

This invention relates to a method and apparatus for treating a boil-off gas in low temperature liquid storage tanks. More particularly, it relates to a method and apparatus for treating a BOG generated in low temperature liquid tanks which are used for storing and transporting low temperature liquids obtained by liquefying various types of gases including methane, ethane, propane and other low hydrocarbons, natural gas, and carbon dioxide. It will be noted that the boil off gas may be sometimes referred to simply as BOG.

2. Prior Art

For storage and transportation of low temperature liquefied gases such as liquefied natural gas (LNG), it is usual to use storage tanks, and the storage tanks are thermally insulated with heat insulators. Nevertheless, heat is liable to enter into the inside of the tank from the external environments of the tank, and thus, part of the liquefied gas in the tank is gasified or evaporated as BOG, thereby causing the inner pressure to increase in the tank. The increase of the inner pressure in the tank may involve some risks such as of the leakage and explosion of gas. In order to avoid the above problem, it may occur that BOG generated in the tank is released therefrom. However, where the BOG consists of a flammable gas or a noxious gas, it cannot be released to the air.

As a measure for solving the above problem, it has been considered to transfer the BOG generated in a low temperature liquid storage tank to a separate vessel. For the transfer, (1) the BOG is transferred by use of a natural stream thereof, i.e. the transfer is carried out by utilizing a stream through a pressure gradient based on the difference in pressure between the low temperature liquid storage tank and the vessel. In this case, however, the pressure in the vessel should be lower than that in the storage tank, thus requiring a pressure reducing device.

(2) Where the transfer cannot rely on a natural stream, a suction pump for forcedly transferring the BOG is necessary. In this case, the transfer pump for that BOG should be provided, for example, at a pipe between the storage tank and the vessel. This promotes gasification and evaporation in the tank the would not occur otherwise. Since the tank and a pipe communicating therefrom are kept at low or very low temperatures, an ordinary type of suction pump cannot be provided, with the attendant problem that a specific type of pump is necessary.

Besides, although it does not differ from the above in that the BOG generated in the low temperature liquid storage tank is transferred via a pipe to a separate vessel other than the storage tank, (3) a vessel used may be one wherein an adsorbent is packed, and the generated BOG is adsorbed to the adsorbent. In fact, this is proposed in JP-A- 8-219397. In this case, the gas is subjected to physical adsorption on the surfaces of a solid adsorbent. The physical adsorption makes use of a phenomenon of equilibrium with pressure, so that not only the adsorption rate is low, but also the adsorption amount is small, with a large amount of adsorbent being required. Therefore, in order to enable the generated BOG to be removed and adsorbed satisfactorily, a vessel with a great capacity and packed with a large amount of an adsorbent becomes necessary.

We have developed a method of storing and transporting gas wherein a large amount of gas can be stored and transported by bringing a compound serving as host and a gas to be stored into contact with a porous material under mild temperature and pressure conditions in a very short time, thereby enabling the gas in an amount, for example, equivalent to not less than 180 times (converted to the standard state basis) as much as an unit volume of the porous material to be stored or transported (Japanese Patent Application No. 8-37526). The porous materials used in this method include active carbon, ceramics and the like, and the host compounds include water, alcohols, organic acids, quinones, hydrogen sulfide, urea and the like.

FIG. 1 is a graph showing an example evidencing the characteristics of the porous material. In this instance, after 0.0083 g of water was adsorbed to 0.0320 g (0.0461 cc) of pitch-based active carbon having a specific surface area of 1765 $m^2/g$, an average pore size of 1.13 nm (nanometers), a pore capacity of 0.971 cc/g, an intrinsic specific gravity of 2.13 g/cc, and an apparent specific gravity of 0.694 g/cc, methane gas under 0.2 atm at 30° C. was fed thereto. For comparison, the above procedure was repeated except that methane gas under the same conditions as mentioned above was fed thereto but without adsorption of any water. In FIG. 1, the variation in the weight of the methane gas adsorbed per 1 g of the active carbon is shown in relation to the variation in time. In FIG. 1, the variation in the gas weight when water was adsorbed to the active carbon prior to the methane gas being adsorbed thereto is plotted with the mark "○" (blank circles), whereas the variation obtained when methane gas was adsorbed straight to the active carbon is plotted with the mark "●" (solid circles).

As shown in FIG. 1, where water was adsorbed to the active carbon first and then the methane gas was fed thereto, the active carbon started to adsorb the methane gas henceforth at a rapid rate with the amount of the methane gas adsorbed after the elapse of 0.2 hours reaching more than 15 mmols per 1 g of the active carbon and the same after the elapse of 0.5 hours reaching around 17 mmols per 1 g of the active carbon, which was maintained thereafter. Considering the fact that the methane gas fed at this point was pressurized at 0.2 atm (at 30° C.), it can be seen that the rate at which the methane gas is adsorbed is remarkable.

On the other hand, when the methane gas was fed without water being adsorbed to the active carbon beforehand as in the conventional methods, only a minimal amount of the methane gas was adsorbed without showing any change in the amount of the methane gas adsorbed after the elapse of time under the same pressure as described above. In this regard, according to the method referred to in JP-A-49-104213, for example, silica gel, molecular sieves, active carbon, and the like are placed in a pressure tank, and methane gas is stored by applying pressure at about 68 atm (equivalent to 1000 psia). In application of this technique, such a high-pressure operation is indispensable even using similar adsorbents described above.

Table 1 shows the results of the comparison of the amounts of methane adsorbed per 1 g of the active carbon as shown in FIG. 1. As shown in Table 1, the amount of methane adsorbed was only 0.18 mmols after the elapse of 0.2 hours in the case where methane was adsorbed straight to the active carbon, whereas it was 12.08 mmols in the case where water was adsorbed to the active carbon beforehand, 67 times as much as the former case. After the elapse of 0.9 hours, the amount of methane adsorbed straight to the active carbon was 0.18 mmols, whereas it was 16.4 mmols in the case of water coexisting with methane, 91 times as much as the former case.

TABLE 1

| Time Elapsed (Hours) | Amount of methane adsorbed per 1 g of active carbon (mmols): Methane adsorbed to the active carbon after water was adsorbed (A) | Methane adsorbed straight to the active carbon (B) | Ratio (A/B) |
|---|---|---|---|
| 0.2 | 12.08 | 0.18 | 67.1 |
| 0.9 | 16.46 | 0.18 | 91.4 |

The volume of methane adsorbed to 1 cc in an apparent volume of the active carbon in the presence of water is calculated as 183 cc on the standard state basis under 1 atm at 0° C. This result shows that methane was stored in a volume exactly 183 times, on the standard state basis, as large as an unit volume of the active carbon under a pressure as low as only 0.2 atm. Then (after the elapse of 0.9 hours), the amount of methane adsorbed was found slightly reduce, and finally reached 11.77 mmols, at which a state of equilibrium was achieved without any change thereafter.

SUMMARY OF THE INVENTION

In view of the various problems of the BOG, we paid attention to the fact, as shown in FIG. 1 and Table 1, that has never been expected from the prior art, and such a fact is applied to the adsorption and storage of the BOG generated in low temperature liquid storage tanks.

It is accordingly an object of the invention to provide a method and apparatus for treating the BOG in a low temperature liquid storage tank wherein it is utilized that when a porous material is employed along with a compound serving as a host, the porous material develops the capability of adsorbing and storing a large amount of gas under mild temperature and pressure conditions.

A method of treating the BOG according to one embodiment of the invention is characterized in that the BOG generated in a low temperature liquid storage tank is brought into contact with a porous material in the presence of a compound serving as a host thereby causing BOG to be adsorbed to and stored in the porous material.

An apparatus of treating the BOG in a low temperature liquid storage tank according to another embodiment of the invention is characterized in that a porous material is placed in a vessel and a compound serving as a host to co-exists with the porous material.

PREFERRED EMBODIMENTS OF THE INVENTION

The porous materials used in the present invention are not critical provided that they are porous materials having fine pores. Preferably, porous materials having a specific surface area of 100 $m^2g$ or above are used. So long as the porous material does not react with or dissolve in water, alcohols or other compounds serving as a host having a similar function therewith (that is, they do not substantially give any adverse influences such as of dissolution, reaction and the like), any porous material may be used irrespective of the type, manner of reparation and shape thereof. Further, the porous materials do not need uniformity with respect to the shape of the fine pores and the distribution of the pore size thereof.

Any porous materials having the characteristics described above may be used in the present invention. Among them, active carbon (including porous carbon) and ceramics are preferably used. The active carbon and ceramics are inexpensive and readily available. The invention is quite advantageous in this regard. Examples of the compound serving as the host include water, alcohols such as methyl alcohol, ethyl alcohol and the like, organic acids such as formic acid, acetic acid and the like, quinones such as benzoquinone, hydrogen sulfide, urea, and the like. Of these, water is preferably used.

According to the invention, a compound serving as the host and the BOG to be adsorbed and stored are brought in contact with a porous material, such as active carbon or a ceramic material, under mild conditions of an ordinary temperature and an ordinary pressure or close to this temperature and this pressure. Through the contact, a large volume of a BOG equivalent, for example, to not less than 180 times (converted to the standard state basis) an unit volume of the porous material can be adsorbed and stored in a short time.

The BOG is generated from liquefied gases of various types of gases including lower hydrocarbons such as methane, ethane, ethylene, propane, butane and mixtures thereof, natural gas and carbon dioxide. These liquefied gases are accommodated in low temperature liquid storage tanks. The BOG stays in the upper space of the low temperature storage tank. In the practice of the invention, this BOG is adsorbed to and stored in the porous material.

Figure 1:
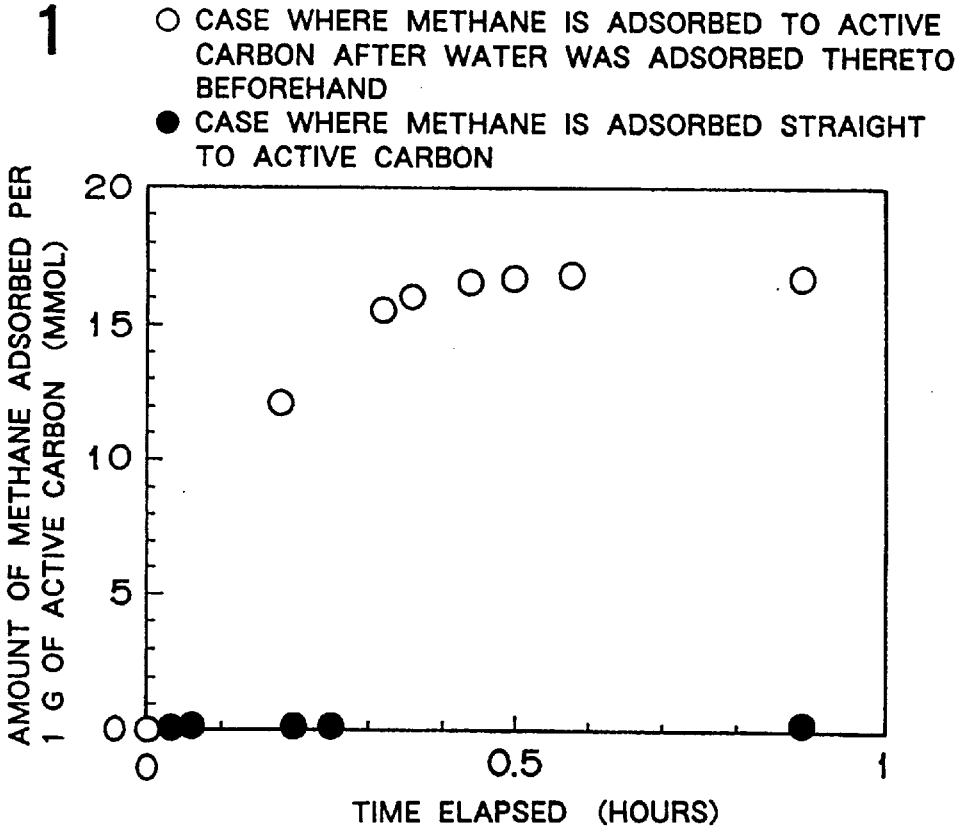
FIG. 1 is a graph showing variation with time in the amount of methane adsorbed to 1 g of active carbon in the presence of water in comparison with the variation when methane was brought straight in contact with the active carbon without presence of water (under 0.2 atm at 30° C.)
Figure 2:
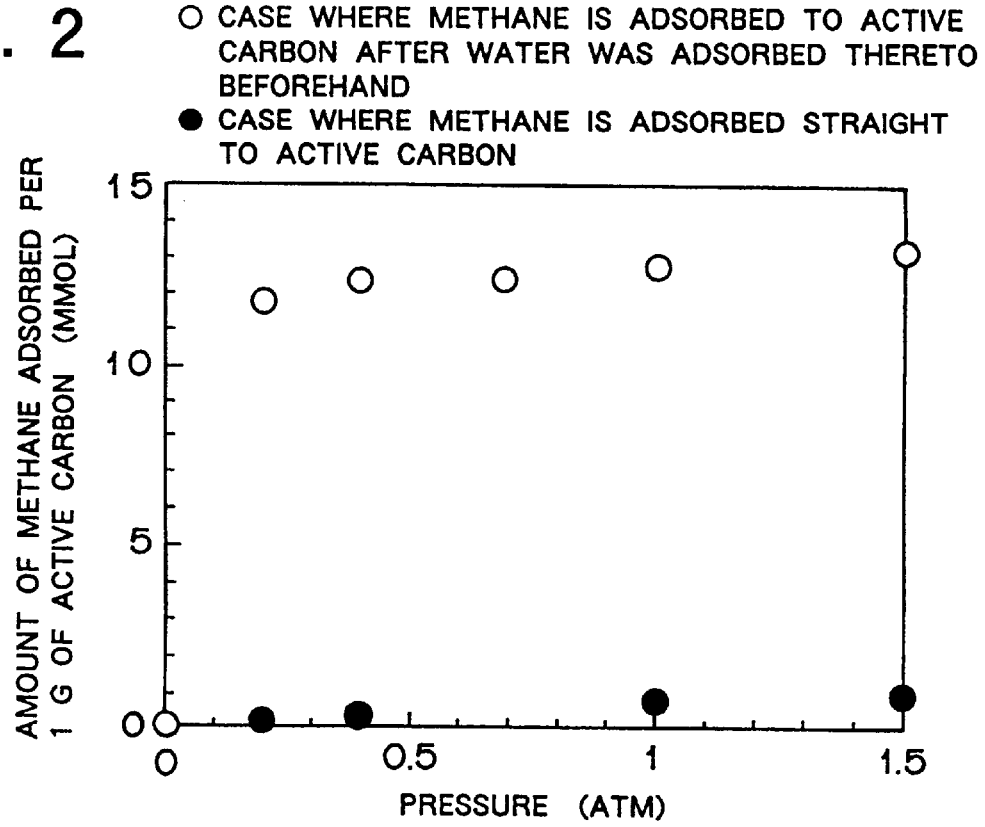
FIG. 2 is a graph showing the variation under different pressures in the amount of methane adsorbed to 1 g of active carbon, comparing the case conducted in the presence of water with the case of methane being brought directly in contact with the active carbon (at 30° C.)
Figure 3:
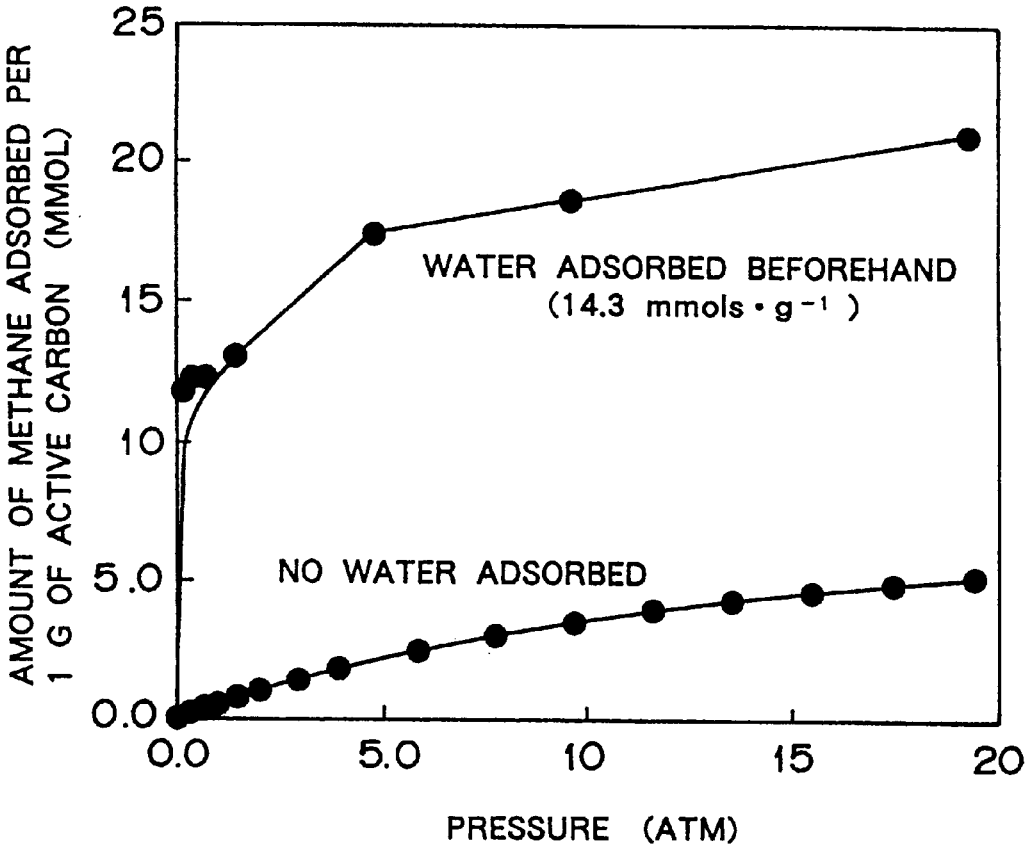
FIG. 3 is a graph showing the variation under different pressures in the amount of methane adsorbed to 1 g of active carbon, comparing the case conducted in the presence of water with the case of methane being brought directly in contact with the active carbon (at 30° C.)

FIGS. 2 and 3 show the pressure characteristics of the porous material used in the invention. More particularly, 0.0083 g of water was adsorbed to 0.0320 g (0.0461 cc) of the active carbon as used to obtain the results of FIG. 1 and Table 1, after which methane gas was fed thereto at 0 to 20 atm., at 30° C., and the amounts of methane gas adsorbed after a static equilibrium was reached at the respective pressures were measured. FIG. 2 shows the variation in the amount under a pressure in the range of from 0 to 1.5 atm, among 0 to 20 atm in FIG. 3, enlarged along the abscissa. In the figures, the variation in the weight of methane adsorbed when water was adsorbed to active carbon beforehand is plotted with the mark "○" (blank circles), whereas the variation obtained when methane gas was adsorbed directly to the active carbon is plotted with the mark "●" (solid circles).

As shown in FIG. 2, in the case where methane is fed after the water is adsorbed beforehand, methane is rapidly stored henceforth, even under a very low pressure, indicating an amount of methane adsorbed at 1 atm at around 12 mmols. It is also indicated that in case of methane gas being fed after the water was adsorbed directly to the active carbon, the amount of methane adsorbed per 1 g of the active carbon under 1.5 atm was about 1 mmol, whereas in case of methane gas being fed after adsorption of the water to the active carbon, the amount of methane adsorbed under the same 1.5 atm was as much as 13 mmols.

Table 2 shows the results of comparison of the amounts of methane adsorbed per 1 g of the active carbon as shown in FIG. 2. As shown in Table 2, in comparing the amounts of methane adsorbed when an equilibrium of adsorption was reached, for example, under 0.2 atm, an amount of methane adsorbed in the presence of water was 11.77 mmols as against the same of only 0.18 mmols when methane was adsorbed directly to the active carbon, representing a ratio of the former to the latter of 65. Further, in comparing the amounts of methane adsorbed when an equilibrium of adsorption was reached under 1.5 atm, the amount of methane adsorbed in the presence of water was 13.08 mmols as against the same of only 0.88 mmols when methane was adsorbed straight to the active carbon, representing the ratio at 15.

TABLE 2

| | Amount of methane adsorbed per 1 g of active carbon (mmols) | | |
|---|---|---|---|
| Pressure (atm) | Methane adsorbed to the active carbon after water was adsorbed (A) | Methane adsorbed straight to the active carbon (B) | Ratio (A/B) |
| 0.2 | 11.77 | 0.18 | 65.4 |
| 1.5 | 13.08 | 0.88 | 14.9 |

FIG. 3 shows the results of a measurement obtained by contacting methane to the active carbon under pressure conditions higher than those of FIG. 2, wherein data under a pressure up to 1.5 atm, as shown in FIG. 2, are plotted as well. As is evident from FIG. 3, when water is present, the amount of methane adsorbed rapidly increased with an increase in the pressure of methane under 1.5 atm and higher, arriving at as much as 21 mmols per 1 g of the active carbon under 20 atm.

In contrast, where methane was adsorbed directly to the active carbon, the amount of methane adsorbed increased only slightly with an increase in the pressure of methane, reaching as small as only around 5 mmols, even under 20 atm. Further, an amount of methane adsorbed pressurized only at 1 atm and adsorbed to the active carbon in coexistence of water was found to be as much as 12 mmols per 1 g of the active carbon, which is more than twice as much as the amount of methane adsorbed (about 5 mmols) under 20 atm when methane was adsorbed directly to the active carbon.

Then, the volumes of methane adsorbed to 1 cc of the active carbon under different pressures according to FIG. 3, converted to respective volumes on the standard state basis, are equivalent to 191 cc under 0.7 atm, 203 cc under 1.5 atm, 271 cc under 5.0 atm, 290 cc under 10 atm, and 326 cc under 20 atm. In this way, according to the invention, not only good adsorption action under reduced pressure or under such a low pressure as of ordinary pressure to 5 atm is attained, but also a more effective adsorption effect can be expected under pressures of 10 atm to 20 atm and higher.

Of course, the BOG can be adsorbed not only under ordinary pressures or a low pressure of 10.68 atm (equivalent to 10 kg/cm$^2$ by gauge pressure), but also under a reduced pressure, for example, of 0.2 atm. Further, under a pressure exceeding 10.68 atm (10 kg/cm$^2$ by gauge pressure), large amounts of the BOG can be removed and adsorbed. Accordingly, the BOG can be adsorbed according to the invention irrespective of the pressure of the BOG generated in the low temperature liquid storage tank. In the method and apparatus of treating BOG, specific types of separate cooling device and heating device are not necessary, along with any specific pressurizing device, and thus are very effective in practice.

For instance, with active carbon, it is readily available in powder form, granular form, fibrous form and various other forms having various pore sizes and large specific surface areas. The pore size distribution and the specific surface area can be readily confirmed by measuring the amount of nitrogen adsorbed at the liquid nitrogen temperature and an adsorption isotherm. As the active carbon material has a very large specific surface area, a very large number of molecules (BOG) can be adsorbed on the surfaces thereof These materials have a sufficiently small pore size, for example, of several nanometers to several tens of nanometers, and as a result, the molecules adsorbed to the surfaces of the fine pores behave as if they were under high pressure conditions. Such behavior represents a phenomenon known as a quasi-high pressure effect. Phase transition, reaction, and the like which occur normally only under a high pressure can occasionally happen under moderate conditions of a lower pressure and lower temperature by use of a porous material having fine pores. The adsorption and storage effects of the invention are presumably attributable to such a phenomenon as described above although the cause thereof is not known in detail.

As for a compound serving as a host in the practice of the invention, there is no specific limitation provided that it is a compound that can form a certain structure through hydrogen bonds when several molecules thereof cluster. As described hereinbefore, water, alcohols, organic acids, quinones, hydrogen sulfide, urea and the like are mentioned. Among them, water is preferably used.

According to hitherto accepted technical knowledge, these host compounds coexist with gas molecules (referred to as "guest molecules") having dimensions in a certain range, and clathrate compounds are formed, causing gas molecules to be crystallized in a very close proximity to each other and stabilized. This is a phenomenon wherein the host compound coexisting with the gas molecules serving as a guest under certain pressure and temperature conditions forms jointly with the gas molecules, through hydrogen bond, specific cubic structures, for example, cage-like structures in which the guest molecules are surrounded by the host molecules, and such clathrates are normally formed under conditions of a low temperature and high pressure.

On the contrary, the invention enables a large amount of the BOG to be stored rapidly, even under mild conditions, without the need of a high pressure, through combination of a high absorbing capacity of the porous material having fine pores, the above-mentioned quasi-high pressure effect inside the fine pores, and the characteristics of the gas capable of forming clathrates. The gas storing capacity obtained according to the method of the invention far exceeds the ratio of the number of guest molecules to that of the host molecules attained by any hitherto known clathrates. Such a phenomenon as described above cannot be explained by any known theory pertaining to the formation of clathrates alone. It appears that some synergistic effects due to the combination of a porous material having fine pores and clathrates, i.e. an effective and excellent gas storage action according to some new and beneficial theory has occurred.

The treatment of the BOG in low temperature storage tanks can be carried out by embodiments including, for example: (1) the porous material is placed in a vessel first, and then a compound serving as the host is fed into the vessel wherein it is adsorbed to the porous material, followed by the further feed of the BOG thereinto; (2) the porous material to which the host compound has already been adsorbed is placed in a vessel, and then the BOG is fed into the vessel; (3) the porous material is placed in a vessel, into which the host compound and BOG are introduced at the same time; and (4) the procedures mentioned above under (1) to (3) are used in combination. However, various embodiments other than the above may be carried out.

The host compound is fed into the vessel, in which the porous material has been placed, as described above, (1) prior to the feed of the BOG, (2) simultaneously with the feed of the BOG, (3) after the feed of the BOG, and (4) by use of two or more of (1) to (3). When the compound is a liquid, it may be gasified and fed into the vessel or may be sprayed in liquid form. Alternatively, when it is water, water vapor is preferably fed into the vessel. Water vapor quickly and uniformly contacts the porous material. Still alternatively, two or more host compounds may be used and fed into the vessel in the form, for example, of an aqueous alcohol solution.

If a liquefied gas placed in the low temperature liquid storage tank is natural gas or a mixed gas of two or more gases, the BOG generated in the upper space contains more volatile gases. The invention is applicable to any type of BOG irrespective of its constituents. The porous material used in the invention is able to adsorb and store a BOG under a low pressure and does not require any high pressure vessel although such a vessel may be used.

The method and apparatus of treating a BOG according to the invention is applied to a BOG generated in a low temperature liquid storage tank during the course of storage and transportation of various types of liquefied gases by use of the low temperature liquid storage tank. Next, the vessel containing the porous material is not critical with respect to its outer shape. For instance, the vessel may be in cylindrical form, cubic form, rectangular parallelepiped form, and other appropriate forms. The constituent materials of the vessel are not critical, and any materials usable for hydrocarbon fuels, such as stainless steels, may be used.

The porous material may be packed in the vessel as it is, or may be appropriately packed in one layer or two or more layers. The vessel is provided with a feed pipe of BOG to be adsorbed and stored. It is possible to arrange such that at the time when or just before the BOG is adsorbed and stored in the vessel to saturation, the thus adsorbed BOG is removed, for example, by application of heat, and a fresh host compound is again fed into the vessel for further adsorption and storage. It will be noted that the feed pipe of the host compound to the vessel may be provided separately from the feed pipe of BOG although one pipe may be used for the both. Further, the pipe may also be used as a pipe of removing the adsorbed BOG.

EXAMPLES

The invention is described in more detail by way of examples, which should not be construed as limiting the invention thereto.

Figure 4:
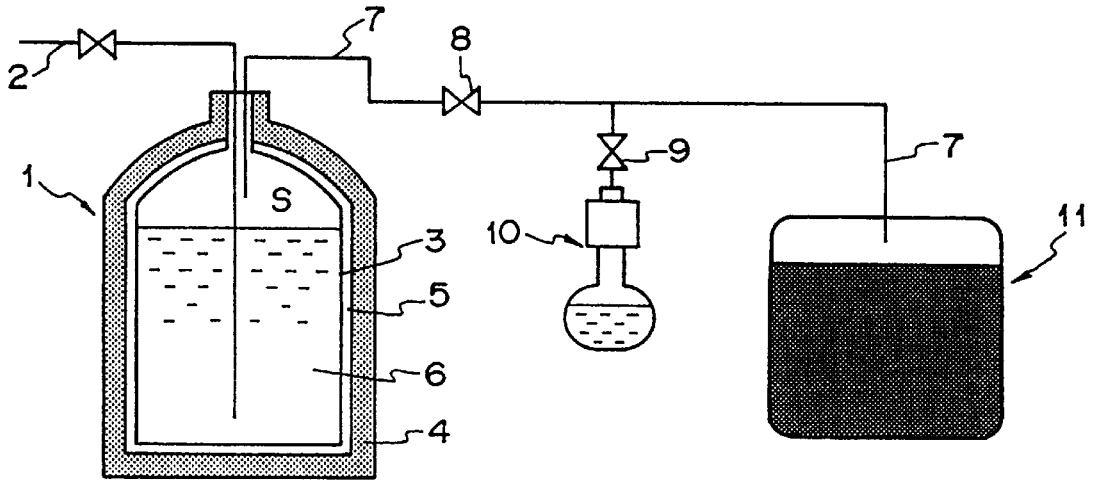
FIG. 4 is a schematic view showing an apparatus for treating the BOG generated in a low temperature liquid storage tank.

FIG. 4 is a schematic view showing an example of an apparatus of treating BOG generated in a low temperature liquid storage tank according to the invention. In FIG. 4, reference numeral 1 indicates a low temperature liquid storage tank, reference numeral 2 indicates a pipe for charging and discharging a low temperature liquid, and the pipe 2 is provided with a valve as shown. The low temperature liquid storage tank 1 has a heat insulating layer 4 surrounding a vessel 3 therewith, and a vacuum heat insulating layer 5 is provided therebetween. Reference numeral 6 is a low temperature liquid stored in the tank 1. BOG generates in a space S above the liquid surface in the tank 1. Reference numeral 7 indicates a pipe for taking out (discharging) BOG from the tank 1.

FIG. 4, reference numeral 11 is a vessel in which a porous material used in the present invention is placed, and the vessel is connected to the pipe 7. For the adsorption and storage of the BOG generated in the space S above the liquid surface in the low temperature liquid storage tank 1, a valve 8 is closed and a valve 9 is opened, under which water vapor is generated by means of a water vapor generating mechanism 10 and fed into the vessel 11. Next, the valve 8 is opened and the valve 9 is closed to feed the BOG into the vessel 11. At the time, the BOG is naturally or substantially naturally adsorbed to and stored in the porous material by the action of the water. It will be noted that the water vapor may be fed into the vessel 11 via a pipe different from the pipe 7.

According to the above-stated procedure, the BOG is rapidly adsorbed to the porous material by the host action of the water vapor or condensed water, and its strong adsorption force does not need any separate power supply. If necessary, a pump or a control valve may be disposed to the pipe 7. The porous material is able to adsorb a large amount of BOG of not less than 180 times as much as that of the porous material, with the porous material not being required in large amounts and the vessel for filling the porous material becoming compact in size.

In the above procedure, water vapor is generated and fed to the porous material first, and then the BOG is fed. It is a matter of fact that the BOG may be fed along with the water vapor (although depending on the pressure and the like conditions in the low temperature liquid storage tank 6). In this case, care should be taken in order not to cause any inconvenience such as the condensation of the water vapor and solidification while controlling the flow rate, temperature and the like of the BOG or adding some technical idea to the inner diameter of the pipe (as 7 in FIG. 4), for example.

Figure 5:
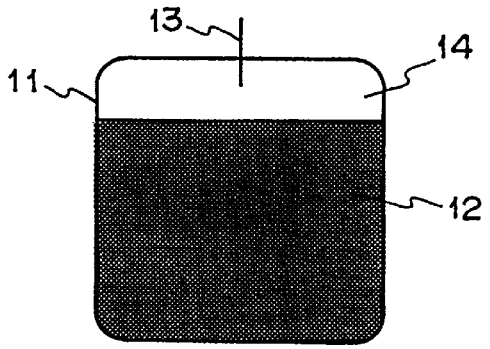
FIGS. 5(*a*) and 5(*b*) are, respectively, vessels accommodating a porous material usable in the present invention.
Figure 5:
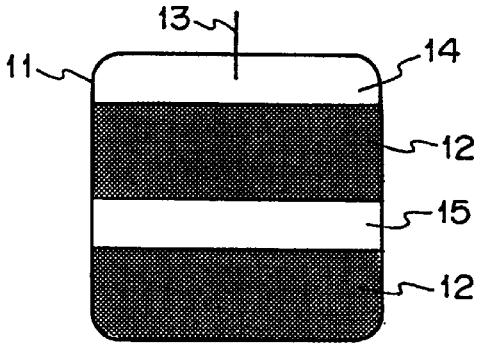

FIGS. 5(*a*) and 5(*b*) are, respectively, a sectional view showing an example of a vessel accommodating the porous material used in the present invention. In FIG. 5(*a*), the porous material is filled in the tank as it is, and in FIG. 5(*b*), the porous material is filled as layers in the tank. In FIG. 5(*b*), two layers are formed as shown, and three or more layers may be used. This is true of multi-layer embodiments appearing hereinafter.

In FIG. 5(*a*) and 5(*b*), reference numeral 11 indicates a vessel, 12 indicates a porous material, and 13 indicates a compound serving as the host and a feed pipe for the BOG. The pipe 13 has an opening in the vessel which is in communication with an upper space 14 of the vessel 11. In FIG. 5(*b*), reference numeral 15 is an intermediate space between the upper and lower layers. At the upper face of the porous material in FIG. 5(*a*) and at the upper and lower faces of the porous materials in FIG. 5(*b*), a member such as a perforated plate or a meshwork. This is true of embodiments appearing hereinafter.

Figure 6:
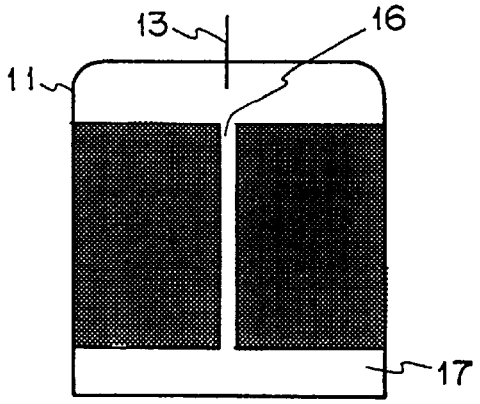
FIGS. 6(*a*) to 6(*e*) are, respectively, different types of vessels accommodating a porous material which can be used in the present invention.
Figure 6:
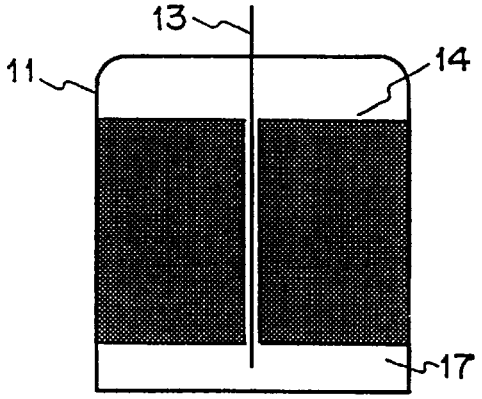
Figure 6:
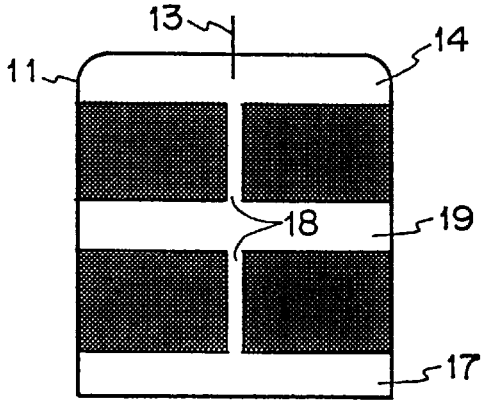
Figure 6:
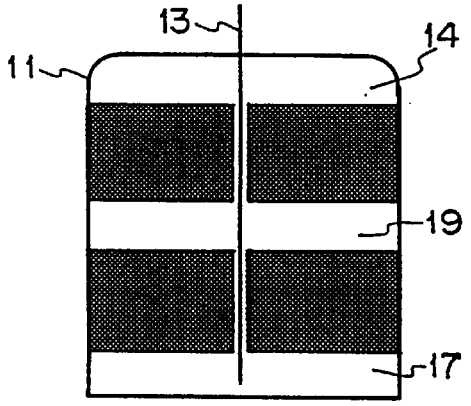
Figure 6:
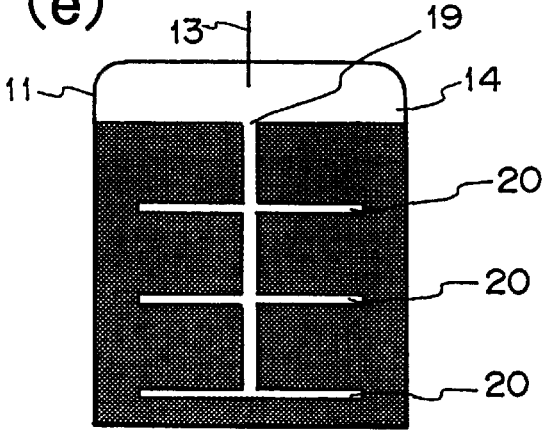

FIGS. 6(*a*) to 6(*e*) are, respectively, further types of vessels accommodating the porous material used in the invention. FIG. 6(*a*) is a view showing a layer of the porous material wherein the layer is formed with a through-hole extending vertically. In FIG. 6(*a*), reference numeral 16 indicates a through-hole, and 17 indicates a lower space. The through-hole 16 is constituted, for example, of a cylindrical meshwork or a hollow cylinder having a multitude of holes in the peripheral walls. Only one through-hole 16 is only one in the embodiment shown in the figure, and two or more through-holes may be provided away from each other, if necessary. The compound serving as the host and BOG, which are fed from the opening of the pipe 13 which extends to the upper space of the vessel, enter from the walls of the through-hole 16, in addition to the upper and lower faces of the porous material layer, and are more uniformly adsorbed to and stored in the porous material.

FIG. 6(*b*) is a modification of FIG. 6(*a*), in which the opening of the pipe 13 in the vessel is arranged to extend to a lower space 17 of the vessel 11. In this case, the compound serving as the host and the BOG, which are fed from the opening of the pipe 13 in the vessel, enter from the walls of the through-hole 16 as well as from the upper and lower faces of the porous material layer, and are more uniformly adsorbed to and stored in the porous material.

In FIG. 6(*c*), two porous material layers are formed with a through-hole being made in the vertical direction. In the figure, reference numeral 18 indicates a through-hole, and 19 indicates an intermediate space between the layers. In FIG. 6(*c*), two layers are formed, but three or more layers may be formed. The through-hole 18 may be constituted, for example, of a meshwork of a cylindrical form or a hollow cylinder having a multitude of pores in the peripheral walls. In the embodiment shown in the figure, one through-hole 18 is formed in each of the upper and lower layers. If necessary, two or more through-holes may be formed and kept apart from each other. In this case, the numbers of through-holes, which are made in the upper and lower layers, may be changed from each other. The compound serving as the host and the BOG, which are fed from the opening of the pipe 13 in the upper space 14 of the vessel 11, enter from the walls of the through-holes 18 as well as from the upper and lower faces of the respective porous material layers and are more uniformly adsorbed to and stored in the porous material.

FIG. 6(*d*) is a modification of FIG. 6(*c*) wherein the opening of the pipe 13 extends to the lower space 17 of the vessel 11. In this case, the compound serving as the host and the BOG, which are fed from the opening of the pipe 13 in the vessel 11, enter from the walls of the through-holes 18 as well as from the upper and lower faces of the respective porous material layers and are more uniformly adsorbed to and stored in the porous material. The pipe 13 in the vessel may have a branch pipe with its opening extending to the upper space 14 and/or the intermediate space 19.

FIG. 6(*e*) is a sectional view showing a further embodiment, in which a through-hole 16 is made vertically in the packing layer of the porous material. A plurality of branch pipes 20 are provided radially from the through-hole 16. The compound serving as host and BOG fed from the opening of the pipe 13 in the vessel enter not only from the upper face of the porous material layer, but also from the walls of the through-holes 16 and the radial branch pipes 20, and are more uniformly adsorbed to and stored in the porous material.

Figure 7:
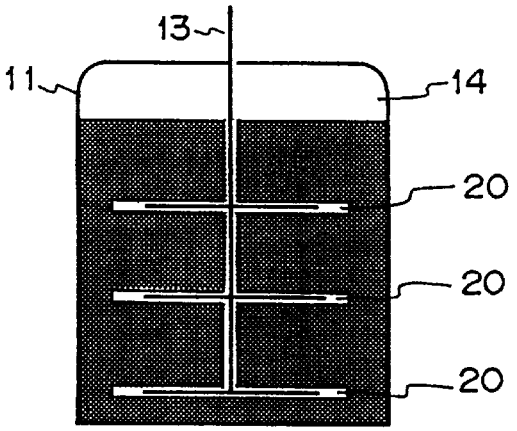
FIGS. 7(*a*) and 7(*b*) are, respectively, further types of vessels accommodating a porous material which can be used in the invention.
Figure 7:
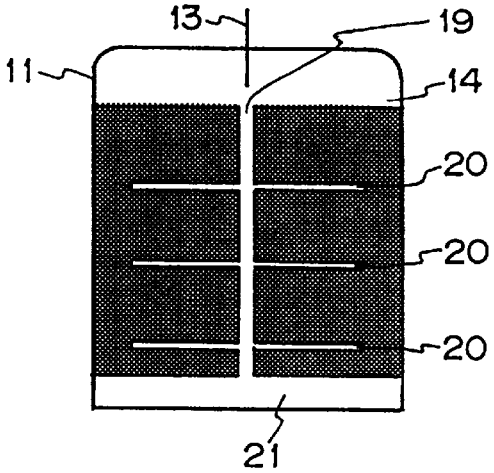

FIGS. 7(*a*) and 7(*b*) are, respectively, a modification of FIG. 6(*e*). FIG. 7(*a*) shows an embodiment wherein the pipe 13 extends from the through-hole 16 toward a plurality of branch pipes 20 provided radially, with its ends being opened at the branch pipes 20. In this case, the compound serving as the host and the BOG fed from the openings of the pipe 13 in the vessel enter not only from the upper and lower faces of the porous material layer, but also from the walls of the individual branch pipes 20, and are more uniformly adsorbed to and stored in the porous material. FIG. 7(*b*) refers to an embodiment wherein a space 8 is formed at the lower portion of the packed layer. Like the case of FIG. 7(*a*), the pipe 13 is provided with branch pipes corresponding to the radial branch pipes 20, with its openings being made at the radially branched pipes 20. The radially branched pipes 20 may have such a structure as that the lung of man having bronchial tubes passing through.

According to the method and apparatus of treating the BOG of the invention, BOG generated in a low temperature liquid storage tank can be effectively treated by use of a porous material capable of strongly adsorbing and storing it under mild temperature and pressure conditions. Inexpensively available porous materials and compounds serving as the host can be employed without need of any specific pressure container as used in the prior art, thus being very advantageous in practical applications.

Since good adsorbing and storing effects can be obtained by use of the porous material and the host compound not only under a low pressure, but also under a pressure of 15 atm, to 20 atom or over, the BOG can be treated in a manner corresponding to the pressure in the low temperature liquid storage tank. Further, the BOG can be adsorbed to and stored in the porous material in an amount as much as not less than 180 times an unit volume of the porous material under a low pressure, the method and apparatus of the invention can be applied to the treatment of BOG in storage tanks of liquefied gases, such as liquefied methane, liquefied natural gas and the like. In addition, the method and apparatus are simple and convenient in that vessels for accommodating the porous material can be made compact in size.

What is claimed is:

1. A method of treating a BOG in a low temperature liquid storage tank, comprising contacting the BOG generated in the low temperature liquid storage tank with a porous material in the presence of a compound serving as a host thereby causing the BOG to be adsorbed to and stored in the porous material.

2. A method according to claim 1, wherein said porous material is active carbon or a ceramic material, and said compound serving as the host is water, an alcohol, an organic acid, a quinone, hydrogen sulfide or urea.

3. A method according to claim 1, wherein said BOG is generated from liquefied natural gas.

4. A method according to claim 1, wherein said BOG is generated from a liquefied gas of a lower hydrocarbon selected from methane, ethane, ethylene, propane, butane and mixtures thereof.

5. A method according to claim 1, wherein said BOG comprises methane.

6. An apparatus for treating BOG comprising a vessel, a porous material contained in the vessel and a compound serving as a host material and the BOG contained in the pores of the porous material.

7. An apparatus according to claim 6, wherein said porous material is active carbon or a ceramic material, and said compound serving as the host material is water, an alcohol, an organic acid, a quinone, hydrogen sulfide or urea.

8. An apparatus according to claim 6, characterized in that said porous material is contained in the vessel in the form of a layer or two or more layers.

9. An apparatus according to claim 6, characterized said porous material contained in said vessel is in the form of a layer or layers having at least one through-hole through which the BOG is passed.

10. An apparatus according to claim 9, characterized in that said porous material has branch pipes for the BOG extending radially from said at least one through-hole.

11. An apparatus according to claim 6, wherein said BOG comprises methane.

* * * * *